United States Patent [19]

Yamanoi

[11] Patent Number: 4,574,993

[45] Date of Patent: Mar. 11, 1986

[54] ELECTRIC STAPLER WITH SLIDING MAGAZINE COVER

[75] Inventor: Noboru Yamanoi, Sakura, Japan

[73] Assignee: Maruzen Kabushiki Kaisha, Tokyo, Japan

[21] Appl. No.: 660,707

[22] Filed: Oct. 15, 1984

[30] Foreign Application Priority Data

Apr. 13, 1984 [JP] Japan ..... 59-74359

[51] Int. Cl.[4] ..... B27F 7/17; B27F 7/36

[52] U.S. Cl. ..... 227/131; 227/125; 227/127

[58] Field of Search ..... 227/120, 127, 131, 125

[56] References Cited

U.S. PATENT DOCUMENTS

| | | | |
|---|---|---|---|
| 2,781,515 | 2/1957 | Juilfs | 227/127 |
| 2,819,466 | 1/1958 | Campbell et al. | 227/127 |
| 3,215,324 | 11/1965 | Dorney | 227/127 X |
| 3,346,163 | 10/1967 | Manganaro | 227/131 |
| 3,554,428 | 1/1971 | Smith | 227/127 X |
| 3,622,061 | 11/1971 | Hoyer et al. | 227/131 X |
| 3,862,712 | 1/1975 | LaPointe et al. | 227/127 |
| 4,491,260 | 1/1985 | Jimena | 227/131 X |

*Primary Examiner*—Paul A. Bell
*Assistant Examiner*—Taylor J. Ross
*Attorney, Agent, or Firm*—James E. Nilles

[57] ABSTRACT

A stapler wherein a staple pushing blade which can be moved up and down from and into a staple guide clearance from which a staple is forced out toward a staple bending groove, and a solenoid having a plunger for moving the staple pushing blade in the vertical direction are provided in a staple container. The staple container is provided with a slider for pressing the staplers toward the staple guide clearance, and a cover member closing an opening at the upper side of the staple container and capable of being moved forward and backward.

2 Claims, 7 Drawing Figures

ELECTRIC STAPLER WITH SLIDING MAGAZINE COVER

BACKGROUND OF THE INVENTION

1. Field of the Invention:

This invention relates to an electric stapler.

2. Description of the Prior Art:

A conventional electric stapler of this kind consists, for example, of a main frame, a staple container serving also as a paper holder and provided on the main frame so that the staple container can be vertically moved, a lift arm provided pivotably at an upper portion of the staple container, a staple pushing blade at a front end portion of the lift arm and used to force out the foremost staple in the staple container into a staple bending groove thereunder, an electric motor provided on the lift frame, and a driving mechanism on the lift arm and operatively connected to the electric motor to be driven thereby.

The lift arm is turned by the driving mechanism driven by the electric motor, to turn the front end portion of the staple container in the downward direction by the staple pushing blade provided at the front end portion of the lift arm and hold the paper by the front end portion of the staple container. The staple pushing blade is further lowered to force out a staple thereby.

However, in the stapler of this construction, the extrusion of staples is done successively in a stepped manner by a mechanical means which is operated in a stepped manner. Therefore, it takes a little time to insert a piece of paper into a stitching zone and drive a staple thereinto and thereby complete a stitching operation. In addition, the stapler has a large number of parts, a complicated construction and large dimensions. It takes much labor to assemble the stapler, and the total manufacturing cost becomes high.

SUMMARY OF THE INVENTION

An object of the present invention is to obtain a stapler capable of lowering a staple pushing blade directly for carrying out a stitching operation; capable of instantly stitching an object material, such as paper instantly; having a smaller number of parts, a very simple construction and small dimensions; and capable of being assembled simply and reducing the total manufacturing cost to a great extent.

The stapler according to the present invention is characterized in that it consists of a staple bending groove provided in a main frame, a staple container formed unitarily with the main frame and having at a front end portion thereof a staple guide clearance through which a staple is forced out into the staple bending groove, a staple pushing blade provided so that the staple pushing blade can be moved up and down freely with respect to the staple guide groove in the staple container, and a solenoid having a plunger for vertically moving the staple pushing blade. When the solenoid is actuated, the staple pushing blade is moved down directly via the plunger thereof to force out a staple from the staple container by the staple pushing blade and stitch an object material therewith.

The above and other objects as well as the advantageous features of the invention will become apparent from the following description of the preferred embodiment taken in conjunction with the drawings.

BRIEF DESCRIPTION OF THE DRAWINGS

The accompanying drawings shown an embodiment of the present invention, wherein.

DESCRIPTION OF THE PREFERRED EMBODIMENT

Figure 1:
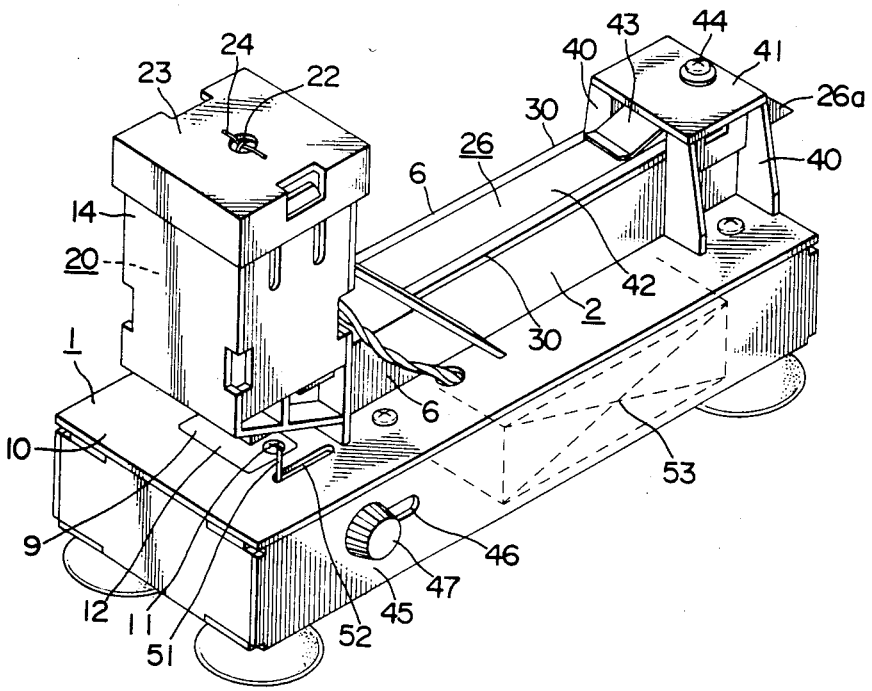
FIG. 1 is a perspective view of a stapler.
Figure 2:
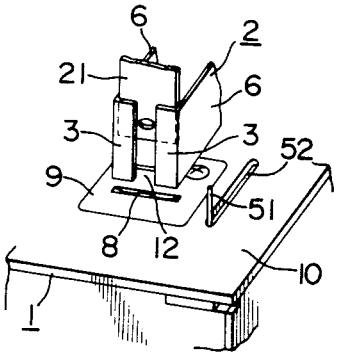
FIG. 2 is a perspective view of a stitching portion of the stapler.
Figure 3:
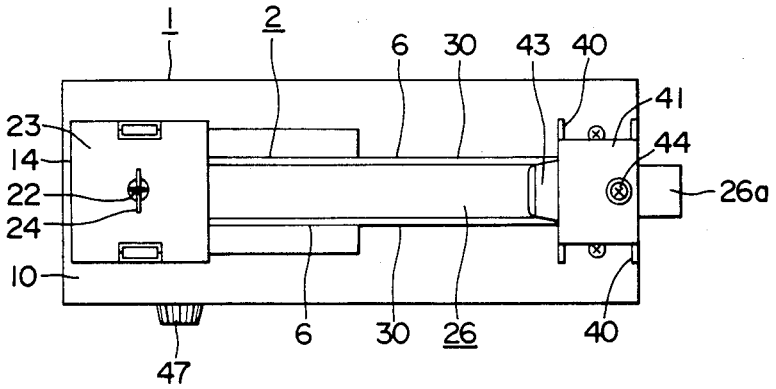
FIG. 3 is a plan view of the stapler.
Figure 4:
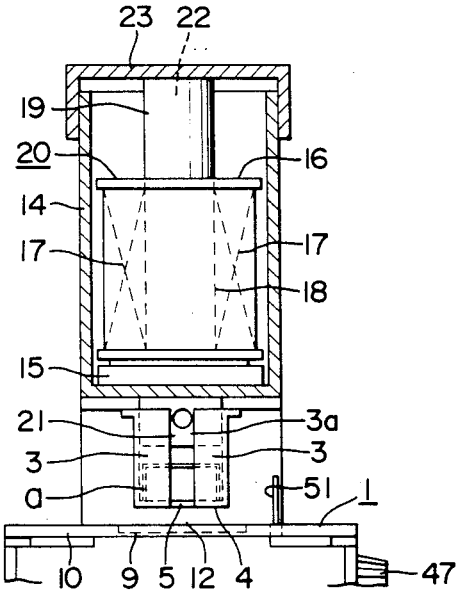
FIG. 4 is a front elevational view of a staple pushing mechanism in the stapler.
Figure 5:
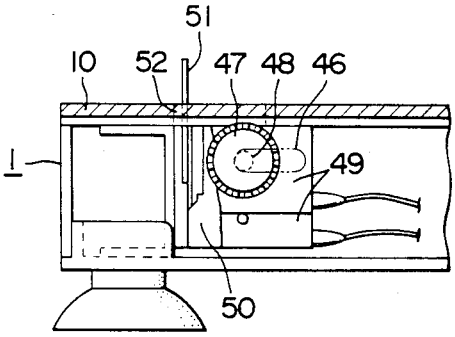
FIG. 5 is a side elevational view of a switch mechanism in the stapler.
Figure 6:
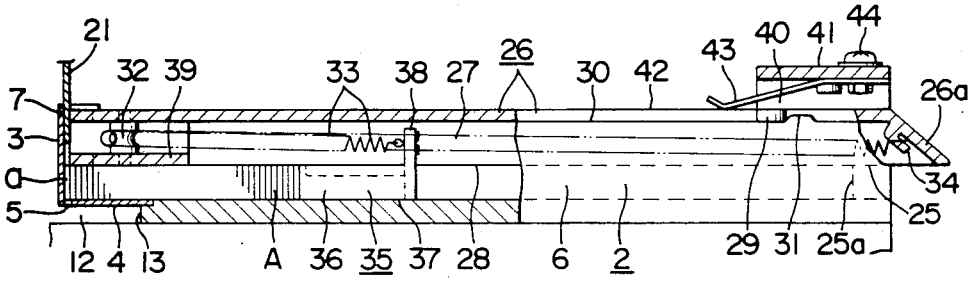
FIG. 6 is a partially sectioned side elevation of a staple container.
Figure 7:
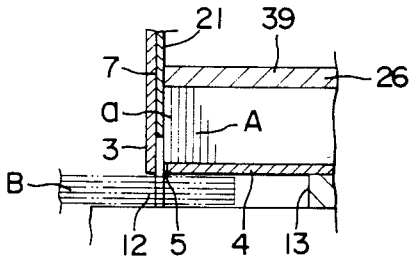
FIG. 7 is a sectional view of the stitching portion shown in FIG. 2.

Referring to the drawings, reference numeral 1 denotes a main frame made of a synthetic resin, and a staple container 2 having a lengthwise-extending opening at the upper side thereof is formed in the central portion of the upper surface of and integrally with the main frame 1. The staple container 2 is provided with vertically-extending blade guide members 3 at a front end portion thereof, and a staple guide clearance 5 through which a staple a out of a plurality of staples A is forced out is formed between the inner lower end portions of the blade guide members 3 and the front end of a bottom wall 4 of the staple container 2. A blade guide clearance 7 is formed between the inner upper end portions of the blade guide members 3 and the front ends of side walls 6 of the staple container 2. The blade guide members 3 have a gap 3*a* between their opposed edges, which gap 3*a* corresponds to the central portions of the clearances 5, 7. A matrix 9 having a staple bending groove 8 is provided on the portion of the main frame 1 which is just under the staple guide clearance 5. The matrix 9 is fastened unitarily with screws 11 to an upper wall 10 of the main frame 1. Between the matrix 9 and staple guide clearance 5, a clearance 12 for inserting a material B to be stitched thereinto is provided, and a stopper 13 is formed in the inner portion of the clearance 12. The height of the clearance 12 is preferably smaller than the length of each leg of a staple a.

A case 14 consisting of a synthetic resin is formed unitarily on the front end portion of the staple container 2. A solenoid 20 provided with a bobbin 16 with a coil 17 therearound, and a plunger 19 extending so as to be moved up and down in a guide bore 18 in the bobbin 16 is fixed to a mounting plate 15 of the case 14. The lower end portion of the plunger 19 in the solenoid 20 is inserted through a guide bore (not shown), which is formed in the mounting plate 15, in such a manner that the lower end portion of the plunger 19 can be moved up and down therethrough. A staple pushing blade 21 is joined unitarily to the lower end portion of the plunger 19 so as to extend in the vertical direction. This staple pushing blade 21 is adapted to be moved up and down from the blade guide clearance 7 along the inner surfaces of the blade guide members 3 and force out one staple a from the staple guide clearance 5. The plunger 19 in the solenoid 20 projects upward from the bobbin 16, and a coiled spring 22 is engaged at its one end portion with the plunger 19 and at the other end portion thereof with an upper wall 23 of the case 14 via a fastener 24. The plunger 19 is urged by the coiled spring 22 constantly in the upward direction so that the upper end portion of the plunger 19 is in a position close to the upper wall 23 and the staple pushing blade 21, which is joined to the lower end of the plunger 19, is positioned above the staple a and standing ready for being forced out. At the inner rear end portions of the opposed side walls 6 of the staple container 2, guides 25 are formed so as to be opposed to each other. A cover member 26 closing the upper side of the staple container 2 is attached to the guides 25 in such a manner that the cover member 26 can be moved forward and backward freely. The cover member 26 consists of a synthetic resin, and is formed to have a substantially inverted U-shaped cross section. The opposed side walls 27 of the cover member 26 are provided at the lower end portions thereof with locking edges 28 engaged slidably with the guides 25.

Locking projections 29 are formed horizontally at the front and rear portions of both sides of the upper edges of the opposed side walls 27. These front and rear locking projections 29 on both of the side walls 27 are engaged slidably with guide rails 30 provided on the upper edges of the opposed side walls 6 of the staple container 2, and they are also adapted to be engaged with and disengaged from locking projections 31 formed at the rear end portions of the opposed guide rails 30. A guide roller 32 is provided pivotably via a shaft in the interior of a front end portion of the cover member 26. A coiled spring 33, an intermediate portion of which is engaged with the guide roller 32, is engaged at one end portion thereof with a projection 34 provided at a rear end portion of the cover member 26, and at the other end portion thereof with a staple pushing slider 35. The slider 35 consists of a synthetic resin, and is formed so as to have an inverted U-shaped cross section. The slider 35 is provided on the bottom wall 4 of the staple container 2 so that the former can be moved slidingly on the latter at the sliding edges 37 formed at the lower ends of the opposed side walls 36 thereof. The slider 35 is provided on its rear end portion with a projection 38 with which the other end portion of the coiled spring 33 is engaged. A cross-sectionally inverted U-shaped stopper 39 is formed integrally with and at the front lower portion of the cover member 26, with which stopper 39 the front end portion of the slider 35 is engageable. The rear end portion of the slider 35 is engageable with the front edges 25*a* of the guides 25.

Support frames 40 consisting of a synthetic resin are provided at both sides of a rear end portion of the staple container 2 in such a manner that the support frames 40 are opposed to each other and project outward from the side walls of the staple container 2. A mounting plate 41 is formed integrally with and between the upper end portions of the right and left support frames 40. A base portion of a resilient retainer 43, which consists of a plate spring urging the upper wall 42 of the cover member 26 resiliently in the downward direction, is fastened unitarily to the lower surface of the mounting plate 41 with a screw 44. The cover member 26 is provided on the staple container 2 via the locking edges 28 engaged with the guides 25 and the front and rear locking projections 29 on both sides thereof, in such a manner that the cover member 26 can be moved forward and backward above the staples A held in the staple container. The slider 35 is positioned below the cover member 26 and adapted to force out the staples A, which are housed in the staple container 2, successively toward the blade guide members 3.

An elongated guide bore 46 is made in one side wall 45 of the main frame 1 so as to extend horizontally. A screw 48 having a knob 47 is inserted movably into the elongated guide bore 46, and a mounting frame 49 is attached to the inner end portion of the screw 48. A microswitch 50 is fastened to the inner portion of the mounting frame 49, and a movable contact 51 of the microswitch 50 is inserted into an elongated guide bore 52 so that the contact 51 can be moved retractably. The elongated guide bore 52 is made in the portion of the upper wall 10 of the main frame 1 which is on one side of the material-inserting clearance 12. When the knob 47 is turned to loosen the screw 48 and move the same along the elongated guide bore 46, the microswitch 50 is moved with the mounting frame 49, and the movable contact 51 of the microswitch 50 is also moved in the longitudinal direction along the elongated guide bore 52. The time at which the solenoid is energized, and the stitching width of the material B are set in accordance with a set position of the movable contact 51. The solenoid 20 and microswitch 50 are connected to a power source through a controller 53.

The energization of the solenoid 20 is done by the controller 53 consisting of an electronic controller provided in the main frame. Namely, when the microswitch 50 is closed, an electronic control means connected there to makes a one-shot action to apply an electric current to the solenoid momentarily.

The operation of the stapler of the above-mentioned construction will now be described.

When a grip 26*a* of the cover member 26 is held to pull out the cover member 26 while lifting the same to a small extent against the resilient retainer 43 so as to be removed from the staple container 2, the locking projections 29 at the rear portion of the cover member 26 run over the locking projections 31, so that the cover member 26 is unlocked.

When the cover member 26 is further pulled out, the stopper 39 in the cover member 26 engages with the slider 35, and the cover member 26 is then drawn out away from the staple container 2 with the slider 35. Consequently, the locking projections 29 at the front portion of the cover member 26 engage with the locking projections 31, and the rear end portion of the slider 35 engages with the front edges 25*a* of the guides 25. As a result, the upper side of the staple container 2 is opened, and an arbitrary number of bars of staples A are then inserted in the staple container 2 from the opened upper side thereof.

When the cover member 26 is pushed back onto the staple container 2 after the insertion of the staples A has been completed, the locking projections 29 at the rear portion of the cover member 26 collide with the locking projections 31. When the cover member 26 is then pressed with a larger force against the resilient retainer 43, the locking projections 29 run over the locking projections 31, and the cover member 26 is held resiliently by the urging force of the resilient retainer 43. Thus, the cover member 26 is set on the staple container 2, and the opened upper side of the latter is closed.

When the cover member 26 is inserted into the staple container 2, the slider 35 is also drawn forward accordingly, and the staples A held in front of the slider 35 are also pressed forwardly by the slider 35. When the foremost staple a then engages the inner surfaces of the blade quide members 3, the movement of the slider 35 is stopped, while the cover member 26 continues to be pushed back against the coiled spring 33 along a path above the staples A via the guide roller 32 to be set in a predetermined position as mentioned previously. Consequently, the coiled spring 33 is accumulated automatically, and the slider 35 is urged forward constantly by this accumulated force. Accordingly, every time a staple a is consumed, the slider 35 advances gradually, i.e. urges the staples A so that the foremost staple a always engages with the inner surfaces of the blade guide members 3 to render the stapler ready for carrying out a stitching operation.

The position in which the movable contact 51 of the microswitch 50 is actuated is set in accordance with a desired width at which the material B is stitched, i.e. a stitching position. Namely, when the knob 47 is turned to loosen the screw 48 joined thereto, and move the screw along the elongated bore 46, the movable contact 51 of the microswitch 50 attached to the screw 48 via the mounting frame 49 is also moved along the elongated guide bore 52. When the knob 47 is then turned in the set position of the movable contact 51 to tighten the screw 48, the microswitch 50 and its movable contact 51 are set and retained in desired positions, and the position in which the movable contact 51 is actuated with respect to the material B to be stitched.

When the material B to be stitched, which consists of paper, is inserted into the clearance 12 between the upper surface of the matrix 9 and the lower end of the staple guide clearance 5 after the microswitch 50 and solenoid 20 have been connected to a power source. the movable contact 51, which projects beyond the portion of the upper surface of the main frame 1 which is at one side of the clearance 12, is pressed by the edge of the inserted material B. As a result, the movable contact is actuated to operate the microswitch 50, so that the solenoid 20 is excited by the controller 53 electrically connected to the microswitch 50. When the solenoid 20 is excited, the plunger 19 therein moves down momentarily against the coiled spring 22, and the foremost staple a is pressed down by the staple pushing blade 21. Consequently, the staple a is separated from the subsequent staple a to be discharged vertically as it is from the staple guide clearance 5. Both legs of the discharged staple a are driven under pressure into the material B, and the lower end portions of the legs of the staple a are bent inward by the pressure, which is applied to the staple a by the blade 21, along the staple bending groove 8 in the matrix 9, so that the material B is stitched momentarily.

After the material B has been stitched, the solenoid 20 stops being excited or is put into a nonexcited state to cause the plunger 19 to be drawn up momentarily by the resilient force of the coiled spring 22, and the stapler stands ready for a subsequent stitching operation. The material B can thus be stitched instantly. Accordingly, a plurality of materials B and a plurality of portions of a material B can be stitched with a high efficiency.

In the embodiment described above, the microswitch 50 is slid to set the position of its movable contact 51. The invention is not limited to this system; for example, the microswitch 50 may be adapted to be moved forward and backward by using, for example, a dial to thereby regulate the amplitude of the movable contact 51. In short, the stapler may be formed so that, when the switch contact of the switching mechanism is pressed by the inserted end portion of the material B, which has been put into the material guide clearance 12, to excite the solenoid, the position in which the switch contact is electrically actuated can be set selectively variable to enable the position, in which the material B is stitched, to be set in accordance with the position of the stopper with respect to the insertion of the material B and the position in which the stopper is operated.

In the above-described embodiment, the stapler is so formed that one portion of a material is stitched at a time but the invention is not limited to such a stapler. For example, a plurality of staple pushing blades adapted to be moved up and down by a solenoid may be arranged in parallel with one another in order that a plurality of portions of a predetermined type of paper can be stitched at once. In this arrangement, the staples provided correspondingly to these staple pushing blades are forced out thereby at once or in a predetermined order in a stepped manner. In this case, a plurality of staple pushing blades may be moved up and down by one solenoid, and these staple pushing blades may be connected to the corresponding solenoids in the manner as in the above-described embodiment.

In order to practice the present invention, at least the cover member 26 for the staple container 2 is preferably made of a light-permeable synthetic resin through which the interior of the staple container 2 can be seen. This enables the quantity of the remaining staples in the staple container 2 to be known visually, and the preparations for inserting a predetermined number of bars of staples into the staple container for subsequent use to be made early.

EFFECT OF THE INVENTION

According to the present invention, a staple pushing blade can be moved up and down by a plunger in a solenoid, so that a material, such as paper can be stitched momentarily at a high speed. Since the staple pushing blade is operated directly by the solenoid, it has no movable portions. This enables the number of parts of the stapler to be reduced, and the construction thereof to be simplified to a great extent. Since the stitching of a material can be carried out speedily and momentarily, it is unnecessary to hold a material firmly before the staple container is moved up and down to drive a staple thereinto. In addition, the construction of the stapler is simple, so that it can be assembled easily to small dimensions. Accordingly, a stitching operation can be done much more efficiently, and the cost of manufacturing the stapler can be reduced greatly.

What is claimed is:

1. A stapler comprising a main frame that defines an elongated staple container which is open at its top and has a downwardly opening staple outlet at its front and along which staples are guided to slide forwardly to said outlet, said main frame also having an upwardly facing surface beneath said staple container and near the front end thereof wherein there is a staple bending groove, a staple pushing blade movable edgewise up and down in the front portion of said staple container and whereby a staple can be driven downward through said outlet and into engagement with said staple bending groove, and a slider in said staple container for urging staples forwardly therein, said stapler being characterized by:

A. a first locking projection fixed on the rear upper end portion of said staple container;

B. a cover member for closing the open top of said staple container, said cover member being slidable forward and rearward on the staple container and (1) having thereon a second locking projection which engages said first locking projection to confine the cover against rearward motion when the cover is in a closed position and which is disengageable from said first locking projection by raising the rear end of the cover, and (2) having an abutment at a lower front end portion thereof against which the slider is engageable and which normally defines a front limit of sliding motion of the slider in the container;

C. a spring reacting between the cover member and the slider to bias the latter forward towards engagement with said abutment;

D. a resilient retainer fixed on the rear upper portion of the main frame for urging the rear end portion of the cover member downwardly; and E. a solenoid having a plunger to which said staple pushing blade is affixed and whereby the staple pushing blade is driven downward against a yielding upward bias thereon.

2. A stapler according to claim 1, wherein said main frame, said staple container and said cover member consist of a synthetic resin.

* * * * *